US006056795A

United States Patent [19]

Ramanath et al.

[11] Patent Number: 6,056,795

[45] Date of Patent: May 2, 2000

[54] STIFFLY BONDED THIN ABRASIVE WHEEL

[75] Inventors: Srinivasan Ramanath, Holden; Richard M. Andrews, Westborough, both of Mass.

[73] Assignee: Norton Company, Worcester, Mass.

[21] Appl. No.: 09/177,770

[22] Filed: Oct. 23, 1998

[51] Int. Cl.[7] ..... B24D 3/06; B24D 3/08; B24D 5/00

[52] U.S. Cl. ..... 51/309; 51/307; 51/308; 51/293; 451/541

[58] Field of Search ..... 51/293, 309, 307, 51/308; 451/541

[56] References Cited

U.S. PATENT DOCUMENTS

| | | | |
|---|---|---|---|
| Re. 21,165 | 7/1939 | Van der Pyl | 51/280 |
| 2,238,351 | 4/1941 | Van der Pyl | 51/309 |
| 2,828,197 | 3/1958 | Blackmer, Jr. | 51/309 |
| 3,779,726 | 12/1973 | Fisk et al. | 51/295 |
| 3,886,925 | 6/1975 | Regan | 125/15 |
| 3,894,673 | 7/1975 | Lowder et al. | 228/122 |
| 3,923,558 | 12/1975 | Shapiro et al. | 148/32.5 |
| 3,925,035 | 12/1975 | Keat | 51/309 |
| 3,999,962 | 12/1976 | Drui et al. | 51/309 |
| 4,024,675 | 5/1977 | Naidich et al. | 51/309 |
| 4,180,048 | 12/1979 | Regan | 125/15 |
| 4,219,004 | 8/1980 | Runyon | 125/15 |
| 4,334,895 | 6/1982 | Keat | 51/309 |
| 4,362,535 | 12/1982 | Isobe et al. | 51/309 |
| 4,378,233 | 3/1983 | Carver | 51/298 |
| 4,457,113 | 7/1984 | Miller | 451/541 |
| 4,471,026 | 9/1984 | Nicholas et al. | 428/450 |
| 4,534,773 | 8/1985 | Phaal et al. | 51/293 |
| 4,591,364 | 5/1986 | Phaal | 51/309 |
| 4,624,237 | 11/1986 | Inoue | 125/15 |
| 4,655,795 | 4/1987 | Bleecker et al. | 51/309 |
| 4,671,021 | 6/1987 | Takahashi et al. | 51/204 |
| 4,685,440 | 8/1987 | Owens | 125/11 |
| 4,798,026 | 1/1989 | Cerceau | 51/204 |
| 4,951,427 | 8/1990 | St. Pierre | 51/293 |
| 5,102,621 | 4/1992 | Sara | 420/470 |
| 5,313,742 | 5/1994 | Corcoran, Jr. et al. | 51/206 |
| 5,385,591 | 1/1995 | Ramanath et al. | 51/309 |
| 5,505,750 | 4/1996 | Andrews | 51/309 |
| 5,718,736 | 2/1998 | Onishi et al. | 51/307 |
| 5,791,330 | 8/1998 | Tselesin | 125/15 |
| 5,832,360 | 11/1998 | Andrews et al. | 428/552 |
| 5,846,269 | 12/1998 | Shiue et al. | 51/295 |
| 5,855,314 | 1/1999 | Shiue et al. | 228/124.5 |

FOREIGN PATENT DOCUMENTS

| | | | |
|---|---|---|---|
| 1086509 | 7/1977 | Canada | B24D 3/10 |
| 1086509 | 9/1980 | Canada . | |
| 8229825 | 2/1995 | Japan | B24D 3/06 |
| 8229826 | 2/1995 | Japan | B24D 3/06 |

OTHER PUBLICATIONS

K. Subramanian, T. K. Puthanangady, S. Liu, "Diamond Abrasive Finishing Of Brittle Materials An Overview," Supertech Superabrasives Technology, 1996, World Grinding Technology Center, Norton Company, Worcester, MA, pp. Cover sheet–25 (No Month).

Stasyuk, L.F.; Kizikov, E.D.; Kushtalova, I.P.; "Structure and Properties of a Diamond–Containing Composition Material with a Tungsten–Free Matrix for a Truing Tool", *Metal Science and Heat Treatment, v 28 n* Nov.–Dec. 1986 pp. 835–839.

Mathewson, W.F.; Ratterman, E.; Gillis, K.H.; "An Analysis of the Coated Diamond/Bond System" Diamond Business Section, General Electric, Detroit, Michigan (Date Unknown).

Kushtalova, I.P.:Stasyuk, L.F.; Kizikov, E.D.; "Development of a Diamond Containing Material With a Tungsten–Free Matrix for Dressing Tools", *Soviet Journal of Superhard Materials v 8 n 1*, Nov.,1986 pp. 48–51.

*Primary Examiner*—Michael Marcheschi
*Attorney, Agent, or Firm*—Jeffrey C. Lew; Mary E. Porter

[57] ABSTRACT

A straight, thin, monolithic abrasive wheel formed of hard and rigid abrasive grains and a sintered metal bond including a stiffness enhancing metal component exhibits superior stiffness. The metals can be selected from among many sinterable metal compositions. Blends of nickel and tin are preferred. The stiffness enhancing metal is a metal capable of providing substantially increased rigidity to the bond without significantly increasing bond hardness. Molybdenum, rhenium, tungsten and blends of these are favored. The sintered bond is generally formed from powders. A diamond abrasive, nickel/tin/molybdenum sintered bond abrasive wheel is preferred. Such a wheel is useful for abrading operations in the electronics industry, such as cutting silicon wafers and alumina-titanium carbide pucks. The stiffness of the novel abrasive wheels is higher than conventional straight monolithic wheels and therefore improved cutting precision and less chipping can be attained without increase of wheel thickness and concomitant increased kerf loss.

46 Claims, No Drawings

STIFFLY BONDED THIN ABRASIVE WHEEL

FIELD OF THE INVENTION

This invention relates to thin abrasive wheels for abrading very hard materials such as those utilized by the electronics industry.

BACKGROUND AND SUMMARY OF THE INVENTION

Abrasive wheels which are both very thin and highly stiff are commercially important. For example, thin abrasive wheels are used in cutting off thin sections and in performing other abrading operations in the processing of silicon wafers and so-called pucks of alumina-titanium carbide composite in the manufacture of electronic products. Silicon wafers are generally used for integrated circuits and alumina-titanium carbide pucks are utilized to fabricate flying thin film heads for recording and playing back magnetically stored information. The use of thin abrasive wheels to abrade silicon wafers and alumina-titanium carbide pucks is explained well in U.S. Pat. No. 5,313,742, the entire disclosure of which patent is incorporated herein by reference. As stated in the '742 patent, the fabrication of silicon wafers and alumina-titanium carbide pucks creates the need for dimensionally accurate cuts with little waste of the work piece material. Ideally, cutting blades to effect such cuts should be as stiff as possible and as thin and flat as practical because the thinner and flatter the blade, the less kerf waste produced and the stiffer the blade, the more straight it will cut. However, these characteristics are in conflict because the thinner the blade, the less rigid it becomes.

Cutting blades are made up basically of abrasive grains and a bond which holds the abrasive grains in the desired shape. Because bond hardness tends to increase with increased stiffness, it would seem logical to raise bond hardness to obtain a stiffer blade. However, a hard bond also has more wear resistance which can retard bond erosion so that the grains become dull before being expelled from the blade. Despite being very stiff, a hard bonded blade demands aggressive dressing and so is less desirable.

Industry has evolved to using monolithic abrasive wheels, usually ganged together on an arbor. Individual wheels in the gang are axially separated from each other by incompressible and durable spacers. Traditionally, the individual wheels have a uniform axial dimension from the wheel's arbor hole to its periphery. Although quite thin, the axial dimension of these wheels is greater than desired to provide adequate stiffness for good accuracy of cut. However, to keep waste generation within acceptable bounds, the thickness is reduced. This diminishes rigidity of the wheel to less than the ideal.

The conventional straight wheel is thus seen to generate more work piece waste than a thinner wheel and to produce more chips and inaccurate cuts than would a stiffer wheel. The '742 patent sought to improve upon performance of ganged straight wheels by increasing the thickness of an inner portion extending radially outward from the arbor hole. The patent discloses that a monolithic wheel with a thick inner portion was stiffer than a straight wheel with spacers. However, the '742 patent wheel suffers from the drawback that the inner portion is not used for cutting, and therefore, the volume of abrasive in the inner portion is wasted. Because thin abrasive wheels, especially those for cutting alumina-titanium carbide, employ expensive abrasive substances such as diamond, the cost of a '742 patent wheel is high compared to a straight wheel due to the wasted abrasive volume.

Heretofore, a metal bond normally has been used for straight, monolithic, thin abrasive wheels intended for cutting hard materials such as silicon wafers and alumina-titanium carbide pucks. A variety of metal bond compositions for holding diamond grains, such as copper, zinc, silver, nickel, or iron alloys, for example, are known in the art. U.S. Pat. No. 3,886,925 discloses a wheel with an abrasive layer formed of high purity nickel electrolytically deposited from nickel solutions having finely divided abrasive suspended in them. U.S. Pat. No. 4,180,048 discloses an improvement to the wheel of the '925 patent in which a very thin layer of chromium is electrolytically deposited on the nickel matrix. U.S. Pat. No. 4,219,004 discloses a blade comprising diamond particles in a nickel matrix which constitutes the sole support of the diamond particles.

A new, very stiff metal bond suitable for binding diamond grains in a thin abrasive wheel has now been discovered. The novel bond composition of nickel and tin with a stiffness enhancing metal component, preferably tungsten, molybdenum, rhenium or a mixture of them provides a superior combination of stiffness, strength and wear resistance. By maintaining the stiffness enhancer within proper proportion to nickel and tin, one can obtain the desired bond properties by pressureless sintering or hot pressing. Thus, while using conventional powder metallurgy equipment, the novel bond can readily supplant traditional, less stiff, bronze alloy based bonds and electroplated nickel bonds.

Accordingly, there is provided an abrasive wheel comprising an abrasive disk consisting essentially of about 2.5–50 vol. % abrasive grains and a complemental amount of a sintered bond of a composition comprising a metal component consisting essentially of nickel and tin, and a stiffness enhancing metal selected from the group consisting of molybdenum, rhenium, tungsten and a mixture of them.

There is also provided a method of cutting a work piece comprising the step of contacting the work piece with at least one abrasive wheel comprising an abrasive disk consisting essentially of about 2.5–50 vol. % abrasive grains and a complemental amount of a sintered bond of a composition comprising a metal component consisting essentially of nickel and tin, and a stiffness enhancing metal selected from the group consisting of molybdenum, rhenium, tungsten and a mixture at least two of them Still further this invention provides a method of making an abrasive tool comprising the steps of (a) providing preselected amounts of particulate ingredients comprising
  (1) abrasive grains; and
  (2) a bond composition consisting essentially of nickel powder, tin powder and a stiffness enhancing metal powder selected from the group consisting of molybdenum, rhenium, tungsten and a mixture of them;
(b) mixing the particulate ingredients to form a uniform composition;
(c) placing the uniform composition into a mold of preselected shape;
(d) compressing the mold to a pressure in the range of about 345–690 MPa for a duration effective to form a molded article;
(e) heating the molded article to a temperature in the range of about 1050–1200° C. for a duration effective to sinter the bond composition; and
(f) cooling the molded article to form the abrasive tool.

Additionally, there is now provided a composition for a sintered bond of a monolithic abrasive wheel comprising a metal component consisting essentially of nickel and tin, and a stiffness enhancing metal selected from the group consisting of molybdenum, rhenium, tungsten and a mixture of at least two of them in which the sintered bond has an elastic modulus of at least about 130 GPa and a Rockwell B hardness less than about 105.

DETAILED DESCRIPTION

The novel bond according to this invention can be applied to straight monolithic abrasive wheels. The term "straight" refers to the geometric characteristic that the axial thickness of the wheel is uniform completely from the diameter of the arbor hole to the diameter of the wheel. Preferably, the uniform thickness is in the range of about 20–2,500 μm, more preferably, about 20–500 μm, and most preferably, about 175–200 μm. The uniformity of wheel thickness is held to a tight tolerance to achieve desired cutting performance, especially to reduce work piece chipping and kerf loss. Variability in thickness of less than about 5 μm is preferred. Typically, the diameter of the arbor hole is about 12–90 mm and the wheel diameter is about 50–120 mm. The novel bond also can be used to advantage in monolithic abrasive wheels which have non-uniform width, such as the thick inner section wheels disclosed in the '742 patent, mentioned above.

The term "monolithic" means that the abrasive wheel material is a uniform composition completely from the diameter of the arbor hole to the diameter of the wheel. That is, basically the whole body of the monolithic wheel is an abrasive disk comprising abrasive grains embedded in a sintered bond. A monolithic wheel does not have an integral, non-abrasive portion for structural support of the abrasive portion, such as a metal core on which the abrasive portion of a grinding wheel is affixed.

Basically, the abrasive disk of this invention comprises three ingredients, namely, abrasive grains, a metal component and a stiffness enhancing metal component. The metal component and the stiffness enhancing metal together form a sintered bond to hold the abrasive grains in the desired shape of the wheel. The sintered bond is achieved by subjecting the components to suitable sintering conditions.

The preferred metal component of this invention is a mixture of nickel and tin of which nickel constitutes the major fraction.

The term "stiffness enhancing metal" means an element or compound that is capable of alloying with the metal component on or before sintering to provide a sintered bond which has a significantly higher elastic modulus than the sintered bond of the metal component alone. Molybdenum, rhenium and tungsten which have elastic moduli of about 324, 460, and 410 GPa, respectively, are preferred. Thus the sintered bond preferably consists essentially of nickel, tin and molybdenum, rhenium, tungsten or a mixture of at least two of molybdenum, rhenium and tungsten. When a mixed stiffening enhancer is used, preferably molybdenum is present as the major component of the stiffness enhancing component while rhenium and/or tungsten are each a minor fraction. By "major fraction" is meant greater than 50 wt %.

It has been found that the stiffness of a stiffened bond for an abrasive article of the aforementioned composition should be enhanced considerably relative to conventional wheels. In a preferred embodiment, the elastic modulus of the novel stiff bonded abrasive wheel is at least about 100 GPa, preferably above about 130 GPa, and more preferably above about 160 GPa.

A primary consideration for selecting the abrasive grain is that the abrasive substance should be harder than the material to be cut. Usually the abrasive grains of thin abrasive wheels will be selected from very hard substances because these wheels are typically used to abrade extremely hard materials such as alumina-titanium carbide. Representative hard abrasive substances for use in this invention are so-called superabrasives such as diamond and cubic boron nitride, and other hard abrasives such as silicon carbide, fused aluminum oxide, microcrystalline alumina, silicon nitride, boron carbide and tungsten carbide. Mixtures of at least two of these abrasives can also be used. Diamond is preferred.

The abrasive grains are usually utilized in fine particle form. Generally, for slicing silicon wafers and alumina-titanium carbide pucks, the particle size of the grains will be in the range selected to reduce chipping the edges of the work piece. Preferably, particle size of the grains should be in the range of about 10–25 μm, and more preferably, about 15–25 μm. Typical diamond abrasive grains suitable for use in this invention have particle size distributions of 10/20 μm and 15/25 μm, in which "10/20" designates that substantially all of the diamond particles pass through a 20 μm opening mesh and are retained on a 10 μm mesh.

Due to the stiffness enhancing metal component, the sintered bond produces a significantly stiffer, i.e., higher elastic modulus, bond than conventional sintered metal bonds used in abrasive applications. Because the novel composition provides a relatively soft sintered bond, the bond wears at appropriate speed to expel dull grains during grinding. Consequently, the wheel will cut more freely with less tendency to load, and therefore, it operates at reduced power consumption. The novel bond of this invention thus affords the advantages of strong, soft metal bonds coupled with high stiffness for precise cutting and low kerf loss.

Both the metal component and stiffness enhancing metal component preferably are incorporated into the bond composition in particle form. The particles should have a small particle size to help achieve a uniform concentration throughout the sintered bond and maximum contact with the abrasive grains for development of high bond strength to the grains. Fine particles of maximum dimension of about 44 μm are preferred. Particle size of the metal powders can be determined by filtering the particles through a specified mesh size sieve. For example, nominal 44 μm maximum particles will pass through a 325 U.S. standard mesh sieve.

In a preferred embodiment, the stiff bonded, thin abrasive wheel comprises sintered bond of about 38–86 wt % nickel, about 10–25 wt % tin and about 4–40 wt % stiffness enhancing metal, the total adding to 100 wt %, preferably about 43–70 wt % nickel, about 10–20 wt % tin and about 10–40 wt % stiffness enhancing metal, and more preferably about 43–70 wt % nickel, about 10–20 wt % tin and about 20–40 wt % stiffness enhancing metal.

The novel abrasive wheel is basically produced by a sintering process of the so-called "cold press" or "hot press" types. In a cold press process, sometimes referred to as "pressureless sintering", a blend of the components is introduced into a mold of desired shape and a high pressure is applied at room temperature to obtain a compact but friable molded article. Usually the high pressure is above about 300 MPa. Subsequently, pressure is relieved and the molded article is removed from the mold then heated to sintering temperature. The heating for sintering normally is done while the molded article is pressurized to a lower pressure than the pre-sintering step pressure, i.e., less than about 100 MPa, and preferably less than about 50 MPa. During this low pressure sintering, the molded article, such as a disk for a thin abrasive wheel, advantageously can be placed in a mold and/or sandwiched between flat plates.

In a hot press process, the blend of particulate bond composition components is put in the mold, typically of graphite, and compressed to high pressure as in the cold process.

However, the high pressure is maintained while the temperature is raised thereby achieving densification while the preform is under pressure.

An initial step of the abrasive wheel process involves packing the components into a shape forming mold. The components can be added as a uniform blend of separate abrasive grains, metal component constituent particles and stiffness enhancing metal component constituent particles. This uniform blend can be formed by using any suitable mechanical blending apparatus known in the art to blend a mixture of the grains and particles in preselected proportion. Illustrative mixing equipment can include double cone tumblers, twin-shell V-shaped tumblers, ribbon blenders, horizontal drum tumblers, and stationary shell/internal screw mixers.

The nickel and tin can be pre-alloyed. Another option includes combining and then blending to uniformity a stock nickel/tin alloy particulate composition, additional nickel and/or tin particles, stiffness enhancing metal particles and abrasive grains.

The mixture of components to be charged to the shape forming mold can include minor amounts of optional processing aids such as paraffin wax, "Acrowax", and zinc stearate which are customarily employed in the abrasives industry.

Once the uniform blend is prepared, it is charged into a suitable mold. In a preferred cold press sintering process, the mold contents can be compressed with externally applied mechanical pressure at ambient temperature to about 345–690 MPa. A platen press can be used for this operation, for example. Compression is usually maintained for about 5–15 seconds, after which pressure is relieved and the preform is heated to sintering temperature.

Heating should take place in an inert atmosphere, such as under low absolute pressure vacuum or under blanket of inert gas. The mold contents are next raised to sintering temperature. Sintering temperature should be held for a duration effective to sinter the bond components. The sintering temperature should be high enough to cause the bond composition to densify but not melt substantially completely. It is important to select metal bond and stiffness enhancing metal components which do not require sintering at such high temperatures that abrasive grains are adversely affected. For example, diamond begins to graphitize above about 1100° C. It is normally desirable to sinter diamond abrasive wheels below this temperature. Because nickel and some nickel alloys are high melting, it is normally necessary to sinter the bond composition of this invention at or above the incipient diamond graphitization temperature, for example at temperatures in the range of about 1050–1200° C. Sintering can be achieved in this temperature range without serious degradation of diamond if the exposure to temperature above 1100° C. is limited to short durations, such as less than about 30 minutes, and preferably less than about 15 minutes.

In one preferred aspect of this invention an additional metal component can be added to the bond composition to achieve specific results. For example, a minor fraction of boron can be added to a nickel containing bond as a sintering temperature depressant thereby further reducing the risk of graphitizing diamond by lowering the sintering temperature. At most about 4 parts by weight (pbw) boron per 100 pbw nickel is preferred.

In a preferred hot press sintering process, conditions are generally the same as for cold pressing except that pressure is maintained until completion of sintering. In either pressureless or hot pressing, after sintering, the sintered products preferably are allowed to gradually cool to ambient temperature. Preferably natural or forced ambient air convection is used for cooling. Shock cooling is disfavored. The products are finished by conventional methods such as lapping to obtain desired dimensional tolerances.

It is preferred to use about 2.5–50 vol. % abrasive grains and a complemental amount of sintered bond in the sintered product. Preferably pores should occupy at most about 10 vol. % of the densified product, i.e., bond and abrasive, and more preferably, less than about 5 vol. %. The sintered bond typically has hardness of about 100–105 Rockwell B and the superficial hardness of the abrasive wheel normally lies in the range of 70–80 on a 15 N scale.

The preferred abrasive tool according to this invention is an abrasive wheel. Accordingly, the typical mold shape is that of a thin disk. The molds are usually stacked in a vertical pile separated by a graphite plate between adjacent disks. A solid disk mold can be used, in which case after sintering a central disk portion can be removed to form the arbor hole. Alternatively, an annular shaped mold can be used to form the arbor hole in situ. The latter technique avoids waste due to discarding the abrasive-laden central portion of the sintered disk.

This invention is now illustrated by examples of certain representative embodiments thereof, wherein, unless otherwise indicated, all parts, proportions and percentages are by weight and particle sizes are stated by U.S. standard sieve mesh size designation. All units of weight and measure not originally obtained in SI units have been converted to SI units.

EXAMPLES

Example 1

Nickel powder (3–7 μm, Acupowder International Co., New Jersey), tin powder (<325 mesh Acupowder International Co.) and molybdenum powder (2–4 μm, Cerac Corporation) were combined in proportions of 58.8% Ni, 17.6% Sn and 23.50% Mo. This bond composition was passed through a 165 mesh stainless steel screen to remove agglomerates and the screened mixture was thoroughly blended in a "Turbula" brand (Glen Mills Corporation, Clifton, N.J.) mixer for 30 minutes. Diamond abrasive grains (15–25 μm) from GE Superabrasives, Worthington, Ohio, was added to the metal blend to form 37.5 vol. % of total metal and diamond mixture. This mixture was blended in a Turbula mixer for 1 hour to obtain a uniform abrasive and bond composition.

The abrasive and bond composition was placed into a steel mold having a cavity of 119.13 mm outer diameter, 6.35 mm inner diameter and uniform depth of 1.27 mm. A "green" wheel was formed by compacting the mold at ambient temperature under 414 MPa (4.65 tons/cm$^2$) for 10 seconds. The green wheel was removed from the mold then heated to 1150° C. under 32.0 MPa (0.36 Ton/cm$^2$) for 10 minutes between graphite plates in a graphite mold. After natural air cooling in the mold, the wheel was processed to finished size of 114.3 mm outer diameter, 69.88 mm inner diameter (arbor hole diameter), and 0.178 mm thickness by conventional methods, including "truing" to a preselected run out, and initial dressing under conditions shown in Table I.

TABLE I

| Truing Conditions Examples 1–2 | |
|---|---|
| Trued Wheel | |
| Speed | 5593 rev./min. |
| Feed rate | 100 mm/min. |
| Exposure from flange | 3.68 mm |
| Truing Wheel | model no. 37C220-H9B4 |
| Composition | silicon carbide |
| Diameter | 112.65 mm |
| Speed | 3000 rev./min. |
| Traverse rate | 305 mm/min. |
| No. of passes | |
| at 2.5 μm | 40 |
| at 1.25 μm | 40 |

TABLE I-continued

| Truing Conditions Examples 1–2 | |
|---|---|
| Initial Dressing | |
| Wheel speed | 2500 rev./min. |
| Dressing stick | type 37C500-GV |
| Dressing stick width | 12.7 mm |
| Penetration | 2.54 mm |
| Feed rate | 100 mm/min. |
| No. of passes | 12 |

Example 2 and Comparative Example 1

The novel wheel manufactured as described in Example 1 and a conventional, commercially available wheel for this application of same size (Comp. Ex. 1) were tested according to the procedure described below. Composition of Comp. Ex. 1 was 48.2% Co, 20.9% Ni, 11.5% Ag, 4.9% Fe, 3.1% Cu, 2.2% Sn, and 9.3% diamond of 15/25 μm. The procedure involved cutting multiple slices through a 150 mm long ×150 mm wide ×1.98 mm thick block of type 3M-3 10 (Minnesota Mining and Manufacturing Co., Minneapolis, Minn.) alumina-titanium carbide glued to a graphite substrate. Before each slice the wheels were dressed as described in Table I except that a single dressing pass per slice and a 19 mm width dressing stick (12.7 mm for Comp. Ex. 1) were used. The abrasive wheels were mounted between two metal supporting spacers of 106.93 mm outer diameter. Wheel speed was 7500 rev./min. (9000 rev./min. for Comp. Ex. 1). A feed rate of 100 mm/min. and cut depth of 2.34 mm were utilized. The cutting was cooled by 56.4 L/min. flow of 5% rust inhibitor stabilized demineralized water discharged through a 1.58 mm ×85.7 mm rectangular nozzle at a pressure of 2.8 kg/cm$^2$.

Cutting results are shown in Table II. The novel wheel performed well against all cutting performance criteria. For example, by the second series of slices, the maximum chip size was lower than that of the comparative wheel and continued to decrease to 7 μm in the forth series of slices. Cut straightness was better than the comparative wheel and wheel wear was on par with Comp. Ex. 1. Also noteworthy was that the Comp. Ex. 1 wheel needed to be operated at 20% higher rotation speed and drew about 52% higher power than the novel wheel (about 520 W vs. about 340 W).

TABLE II

| | Slices | | Cum. Length | Wheel Wear | | | Work piece | | Cut Straight- | Spin Power |
|---|---|---|---|---|---|---|---|---|---|---|
| | No. | Cum. No. | sliced m | Radial μm | Cum. μm | factor[1] μm/m | Max Chip μm | Avg Chip μm | ness μm | Draw W |
| Ex. 1 | 9 | 9 | 1.35 | 5.08 | 5.08 | 7.4 | 13 | <5 | <5 | 272–328 |
| | 9 | 18 | 2.70 | 5.08 | 10.16 | 7.4 | 8 | <5 | <5 | 336–288 |
| | 9 | 27 | 4.05 | 2.54 | 12.70 | 3.7 | 8 | <5 | <2.5 | 288–296 |
| | 9 | 36 | 5.40 | 2.54 | 15.24 | 3.7 | 7 | <5 | <5 | 264–296 |
| Comp. Ex. 1 | 9 | 9 | 1.35 | 5.08 | 5.08 | 3.7 | 11 | <5 | <5 | 520–536 |
| | 9 | 18 | 2.70 | 10.16 | 15.24 | 7.4 | | | | |
| | 9 | 27 | 4.05 | 5.08 | 20.32 | 3.7 | | | | |
| | 9 | 36 | 5.40 | 2.54 | 22.86 | 1.9 | 10 | <5 | <5 | |
| | 9 | 45 | 6.75 | 5.08 | 27.94 | 3.7 | | | | |
| | 9 | 54 | 8.10 | 2.54 | 30.48 | 1.9 | | | | |
| | 9 | 63 | 9.45 | 5.08 | 35.56 | 3.7 | 14 | <5 | <5 | 560–576 |

[1]Wear factor = Radial wheel wear divided by length of work piece sliced

Examples 3–4 and Comparative Examples 2–6

The stiffness of various abrasive wheel and bond compositions was tested. Fine metal powders with and without diamond grains were combined in proportions shown in Table III and mixed to uniform composition as in Example 1. Tensile test specimens were produced by compressing the compositions in dogbone-shaped molds at ambient temperature under pressure in the range of 414–620 MPa (30–45 Tons/in$^2$) for 10 seconds duration, followed by sintering under vacuum as described in Example 1.

The test specimens were subjected to sonic modulus analysis and to standard tensile modulus measurement on a Model 3404 Instron tensile test machine. Results are shown in Table III. Tensile modulus of the novel wheel sample (Ex. 3) far exceeded 100 GPa and was dramatically higher than the moduli of conventional thin abrasive wheels (Comp. Exs. 2 and 4).

Example 4 demonstrates that a stiffness enhancing metal containing sintered bond produces a remarkably high stiffness relative to conventional bond compositions of Comp. Ex. 3 and 5. It is believed that this high sintered bond composition is largely responsible for the overall high stiffness of the abrasive tool. Furthermore, the novel nickel/tin/stiffness enhancer compositions of this invention provide superior stiffness without sacrifice of bond strength, sintered density, or other wheel manufacturing characteristics. The novel bond compositions thus are useful for making abrasive tools and especially thin abrasive wheels for cutting extremely hard work pieces.

TABLE III

| | Ex. 3* | Ex. 4** | Comp. Ex. 2 | Comp. Ex. 3 | Comp. Ex. 4 | Comp. Ex. 5 |
|---|---|---|---|---|---|---|
| Copper, wt % | | | 70 | 70 | 62 | 62 |
| Tin, wt % | 17.6 | 17.6 | 9.1 | 9.1 | 9.2 | 9.2 |
| Nickel, wt % | 58.8 | 58.8 | 7.5 | 7.5 | 15.3 | 15.3 |
| Molybdenum | 23.6 | 23.6 | | | | |
| Iron, wt % | | | 13.4 | 13.4 | 13.5 | 13.5 |
| Diamond, vol. % | 18.8 | | 18.8 | | 18.8 | |
| Sonic Modulus, GPa | 148 | | 95 | | 99 | |
| Tensile Modulus, GPa | 166 | 210 | | 106 | 103 | 95 |

*cold press sintered (pressureless sintering)
**hot press sintered

Example 5

A specimen of a bond composition of 14% tin, 48% nickel and 38% tungsten powders was prepared as in Examples 3–4 and tested for elastic modulus. The tensile modulus was 303 GPa. For comparison, elemental nickel, tin and tungsten have elastic moduli of 207, 41.3 and 410 GPa, respectively. Although the sample did not contain abrasive grains, this example shows the high modulus that can be obtained by a nickel/tin bond stiffened with as little 38% tungsten.

Although specific forms of the invention have been selected for illustration in the examples, and the preceding description is drawn in specific terms for the purpose of describing these forms of the invention, this description is not intended to limit the scope of the invention which is defined in the claims.

What is claimed is:

1. An abrasive wheel comprising an abrasive disk consisting essentially of about 2.5–50 vol. % abrasive grains and a complemental amount to total 100 vol. % of a sintered bond of a component consisting essentially of nickel and tin, and a stiffness enhancing metal selected from the group consisting of molybdenum, rhenium, tungsten and a mixture of at least two of said stiffness enhancing metals.

2. The abrasive wheel of claim 1 in which disk has an elastic modulus of at least about 130 GPa.

3. The abrasive wheel of claim 1 in which the component consists essentially of a major fraction of nickel and a minor fraction of tin.

4. The abrasive wheel of claim 3 in which the sintered bond consists essentially of (a) about 38–86 wt % nickel;

(b) about 10–25 wt % tin; and (c) about 4–40 wt % stiffness enhancing metal and in which the total of (a), (b) and (c) is 100 wt %.

5. The abrasive wheel of claim 4 in which the stiffness enhancing metal is molybdenum.

6. The abrasive wheel of claim 4 in which the stiffness enhancing metal is rhenium.

7. The abrasive wheel of claim 4 in which the stiffness enhancing metal is tungsten.

8. The abrasive wheel of claim 4 in which the stiffness enhancing metal is a mixture of at least two of molybdenum, rhenium or tungsten.

9. The abrasive wheel of claim 8 in which molybdenum comprises a major fraction of the mixture.

10. The abrasive wheel of claim 1 in which the sintered bond consists essentially of sintered nickel powder, tin powder, and stiffness enhancing metal powder.

11. The abrasive wheel of claim 1 in which the abrasive grains are of a hard abrasive selected from the group consisting of diamond, cubic boron nitride, silicon carbide, fused aluminum oxide, microcrystalline alumina, silicon nitride, boron carbide, tungsten carbide and mixtures of at least two of said abrasives.

12. The abrasive wheel of claim 11 in which the abrasive grains are diamond.

13. The abrasive wheel of claim 4 having a uniform width in the range of 20–2,500 μm.

14. The abrasive wheel of claim 13 in which the abrasive grains are present in an amount of about 20–50 vol. % of the disk and the disk has pores which occupy at most about 10 vol. % of the sintered bond and abrasive.

15. The abrasive wheel of claim 13 consisting essentially of the abrasive disk which has a circumferential rim diameter of about 40–120 mm, which defines an axial arbor hole of about 12–90 mm, which has a uniform width in the range of about 175–200 μm and which consists essentially of diamond grains and sintered bond consisting essentially of about 18 wt % tin, about 24 wt % molybdenum and about 58 wt % nickel.

16. The abrasive wheel of claim 13 consisting essentially of the abrasive disk which has a circumferential rim diameter of about 40–120 mm, which defines an axial arbor hole of about 12–90 mm, which has a uniform width in the range of about 175–200 μm and which consists essentially of diamond grains and sintered bond consisting essentially of about 18 wt % tin, about 24 wt % tungsten and about 58 wt % nickel.

17. The abrasive wheel of claim 13 consisting essentially of the abrasive disk which has a circumferential rim diameter of about 40–120 mm, which defines an axial arbor hole of about 12–90 mm, which has a uniform width in the range of about 175–200 μm and which consists essentially of diamond grains and sintered bond consisting essentially of about 18 wt % tin, about 24 wt % rhenium and about 58 wt % nickel.

18. A method of cutting a work piece comprising the step of contacting the work piece with at least one abrasive wheel comprising an abrasive disk consisting essentially of about 2.5–50 vol. % abrasive grains and a complemental amount to total 100 vol. % of a sintered bond of a component consisting essentially of nickel and tin, and a stiffness enhancing metal selected from the group consisting of molybdenum, rhenium, tungsten and a mixture of at least two of said-stiffness enhancing metals.

19. The method of claim 18 in which the abrasive wheel consists essentially of the abrasive disk which has a circumferential rim diameter of about 40–120 mm, which defines an axial arbor hole of about 12–90 mm, and which has uniform width in the range of about 175–200 μm, which abrasive disk consists essentially of diamond grains and a sintered bond of composition consisting essentially of about 38–86 wt % nickel, 10–25 wt % tin and 4–40 wt % molybdenum, the total of nickel, tin and molybdenum being 100 wt %.

20. The method of claim 18 in which the work piece is selected from the group consisting of alumina-titanium carbide and silicon.

21. The method of claim 18 in which the abrasive wheel consists essentially of the abrasive disk which has a circumferential rim diameter of about 40–120 mm, which defines an axial arbor hole of about 12–90 mm, and which has uniform width in the range of about 175–200 μm, which abrasive disk consists essentially of diamond grains and a sintered bond consisting essentially of about 38–86 wt % nickel, 10–25 wt % tin and 4–40 wt % tungsten, the total of nickel, tin and tungsten being 100 wt %.

22. The method of claim 21 in which the work piece is selected from the group consisting of alumina-titanium carbide and silicon.

23. The method of claim 18 in which the abrasive wheel consists essentially of the abrasive disk which has a circumferential rim diameter of about 40–120 mm, which defines an axial arbor hole of about 12–90 mm, and which has uniform width in the range of about 175–200 μm, which abrasive disk consists essentially of diamond grains and a sintered bond consisting essentially of about 38–86 wt % nickel, 10–25 wt % tin and 4–40 wt % rhenium, the total of nickel, tin and rhenium being 100 wt %.

24. The method of claim 23 in which the work piece is selected from the group consisting of alumina-titanium carbide and silicon.

25. A method of making an abrasive tool comprising the steps of (a) providing particulate ingredients comprising
  (1) abrasive grains; and
  (2) a bond composition consisting essentially of nickel powder, tin powder and a stiffness enhancing metal powder selected from the group consisting of molybdenum, rhenium, tungsten and a mixture of at least two of said stiffness enhancing metal powders;

(b) mixing the particulate ingredients to form a uniform composition;

(c) placing the uniform composition into a mold;

(d) compressing the mold to a pressure in the range of about 345–690 MPa for a duration effective to form a molded article;

(e) heating the molded article to a temperature in the range of about 1050–1200° C. for a duration effective to sinter the bond composition; and (f) cooling the molded article to form the abrasive tool.

26. The method of claim 25 which further comprises the step of reducing the pressure on the molded article to a low pressure less than 100 MPa after the compressing step and maintaining the low pressure during the heating step.

27. The method of claim 26 in which the pressure on the molded article is maintained in the range of about 25–75 MPa during the heating step.

28. The method of claim 26 in which the particulate ingredients consist essentially of (a) about 38–86 wt % nickel; (b) about 10–25 wt % tin; and (c) about 4–40 wt % molybdenum, the total of (a), (b) and (c) being 100 wt %.

29. The method of claim 26 in which the particulate ingredients consist essentially of (a) about 38–86 wt % nickel; (b) about 10–25 wt % tin; and (c) about 4–40 wt % tungsten, the total of (a), (b) and (c) being 100 wt %.

30. The method of claim 26 in which the particulate ingredients consist essentially of (a) about 38–86 wt & nickel; (b) about 10–25 wt % tin; and (c) about 4–40 wt % rhenium, the total of (a), (b) and (c) being 100 wt %.

31. The method of claim 26 in which the abrasive tool is a disk having a uniform width in the range of about 175–200 μm, a circumferential rim diameter of about 40–120 mm and which disk defines an axial arbor hole of about 12–90 mm.

32. The method of claim 26 in which the particulate ingredients comprise about 20–50 vol. % abrasive grains of a hard abrasive selected from the group consisting of diamond, cubic boron nitride, silicon carbide, fused aluminum oxide, microcrystalline alumina, silicon nitride, boron carbide, tungsten carbide and mixtures of at least two of said abrasives.

33. The method of claim 32 in which the abrasive grains are diamond.

34. The method of claim 25 in which the heating step occurs while the molded article is maintained at the pressure of the compressing step.

35. The method of claim 34 in which the particulate ingredients consist essentially of (a) about 38–86 wt % nickel; (b) about 10–25 wt % tin; and (c) about 4–40 wt % molybdenum, the total of (a), (b) and (c) being 100 wt %.

36. The method of claim 34 in which the particulate ingredients consist essentially of (a) about 38–86 wt % nickel; (b) about 10–25 wt % tin; and (c) about 4–40 wt % tungsten, the total of (a), (b) and (c) being 100 wt %.

37. The method of claim 34 in which the particulate ingredients consist essentially of (a) about 38–86 wt % nickel; (b) about 10–25 wt % tin; and (c) about 4–40 wt % rhenium, the total of (a), (b) and (c) being 100 wt %.

38. The method of claim 34 in which the particulate ingredients comprise about 20–50 vol. % abrasive grains of a hard abrasive selected from the group consisting of diamond, cubic boron nitride, silicon carbide, fused aluminum oxide, microcrystalline alumina, silicon nitride, boron carbide, tungsten carbide and mixtures of at least two of said abrasives.

39. The method of claim 38 in which the abrasive grains are diamond.

40. A composition for a sintered bond of a monolithic abrasive wheel consisting essentially of nickel and tin, and a stiffness enhancing metal selected from the group consisting of molybdenum, rhenium, tungsten and a mixture of at least two of them, in which the sintered bond has an elastic modulus of at least about 130 GPa and a Rockwell B hardness less than about 105.

41. The composition of claim 40 which consists essentially of about 38–86 wt % nickel, about 10–25 wt % tin and about 4–40 wt % stiffness enhancing metal, the total of nickel, tin and stiffness enhancing metal being 100 wt %.

42. The composition of claim 40 in which the stiffness enhancing metal is molybdenum.

43. The composition of claim 40 in which the stiffness enhancing metal is tungsten.

44. The composition of claim 40 in which the stiffness enhancing metal is rhenium.

45. The composition of claim 40 in which the stiffness enhancing metal is a mixture of at least two of molybdenum, rhenium or tungsten.

46. The composition of claim 45 in which molybdenum comprises a major fraction of the mixture.

* * * * *

UNITED STATES PATENT AND TRADEMARK OFFICE

CERTIFICATE OF CORRECTION

PATENT NO. : 6,056,795
APPLICATION NO. : 09/177770
DATED : May 2, 2000
INVENTOR(S) : Srinivasan Ramanath and Richard M. Andrews It is certified that error appears in the above-identified patent and that said Letters Patent is hereby corrected as shown below:

In claim 28, column 11, lines 48-49, delete “particulate ingredients consist” and insert in place thereof --the bond composition consists--.

In claim 29, column 11, lines 52-53, delete “particulate ingredients consist” and insert in place thereof --the bond composition consists--.

In claim 30, column 11, lines 56-57, delete “particulate ingredients consist” and insert in place thereof --the bond composition consists--.

In claim 35, column 12, lines 16-17, delete “particulate ingredients consist” and insert in place thereof --the bond composition consists--.

In claim 36, column 12, lines 20-21, delete “particulate ingredients consist” and insert in place thereof --the bond composition consists--.

In claim 37, column 12, lines 24-25, delete “particulate ingredients consist” and insert in place thereof --the bond composition consists--.

Signed and Sealed this

Nineteenth Day of February, 2008

JON W. DUDAS
*Director of the United States Patent and Trademark Office*